US005566508A

United States Patent [19]

Houston

[11] Patent Number: 5,566,508

[45] Date of Patent: Oct. 22, 1996

[54] DRIVE SYSTEM FOR A SLIDING CHAMBER DOOR

[75] Inventor: John C. Houston, Erie, Pa.

[73] Assignee: American Sterilizer Company, Erie, Pa.

[21] Appl. No.: 308,661

[22] Filed: Sep. 19, 1994

[51] Int. Cl.[6] ..... E05F 3/00; E05F 11/00

[52] U.S. Cl. ..... 49/445; 49/360; 49/379

[58] Field of Search ..... 49/379, 445, 360

[56] References Cited

U.S. PATENT DOCUMENTS

| | | | |
|---|---|---|---|
| 3,481,387 | 12/1969 | Purdy | 49/360 X |
| 3,511,593 | 5/1970 | Thomas et al. . | |
| 4,083,149 | 4/1978 | Hickman et al. | 49/360 X |
| 4,095,371 | 6/1978 | Knippel | 49/360 X |
| 4,674,231 | 6/1987 | Radek et al. | 49/360 X |
| 5,216,782 | 6/1993 | Schenck et al. | 49/360 X |
| 5,237,777 | 8/1993 | Houston et al. | 49/360 |
| 5,249,392 | 10/1992 | Houston et al. . | |

FOREIGN PATENT DOCUMENTS

| | | |
|---|---|---|
| 0258919 | 3/1988 | European Pat. Off. . |
| 2444776 | 7/1980 | France . |
| 2449186 | 9/1980 | France . |
| 2627894 | 1/1978 | Germany . |

*Primary Examiner*—Philip C. Kannan
*Attorney, Agent, or Firm*—Jones, Day, Reavis & Pogue

[57] ABSTRACT

An apparatus is disclosed for mounting a chamber door between open and closed positions relative to the opening of a sterilizer or autoclave chamber. The apparatus is adapted to be used in either motorized or non-motorized embodiments. The weight of the chamber door is offset by a counterweight and suspended using a cable and pulley system. In the non-motorized embodiment, the door/counterweight system is held in place by a securement, which, when disengaged, permits free motion of the door. In the motorized embodiment, a second cable and pulley system is used to connect the door and counterweight. The cable from this second system is looped around a sheave which is adapted to provide a predetermined frictional force. The sheave is then connected to and rotated by a motor, and upon activation of the motor, the rotating sheave displaces the cable, which respectively raises or lowers the door and counterweight. In the event that the door is obstructed during operation or forced open, the cable will slip harmlessly along the sheave, and will neither injure the operator nor induce damaging torques in the motor.

14 Claims, 3 Drawing Sheets

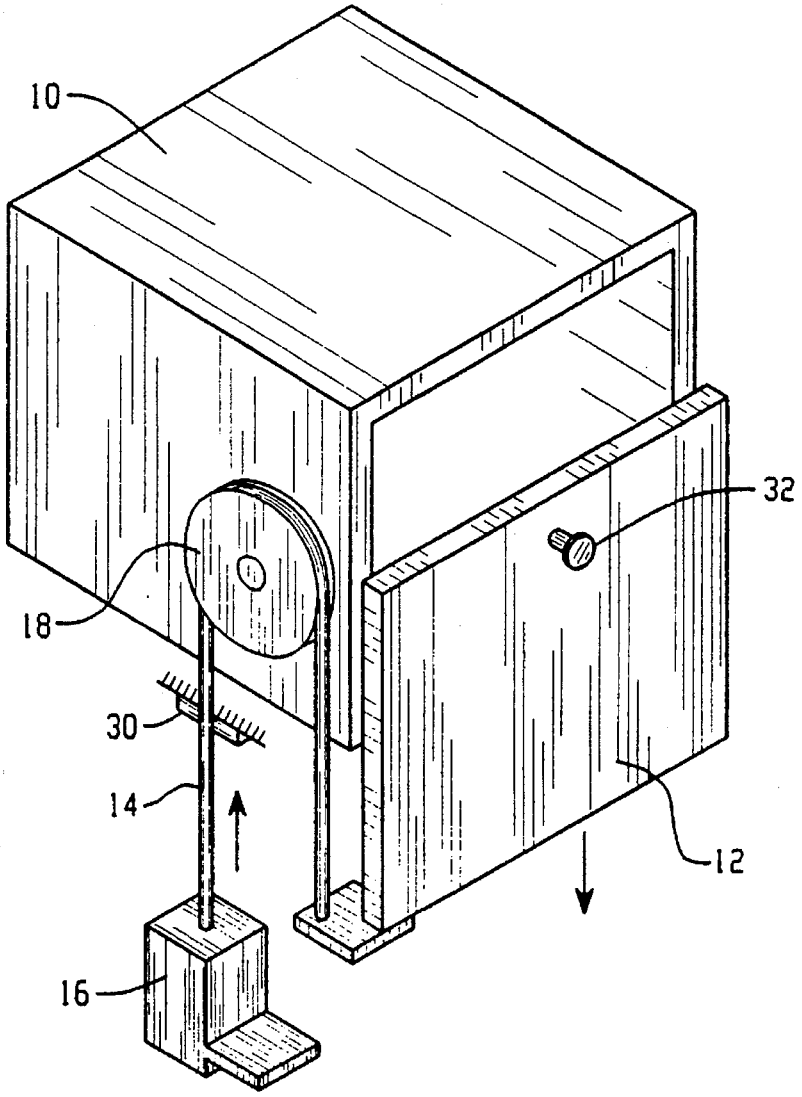
FIG. 2
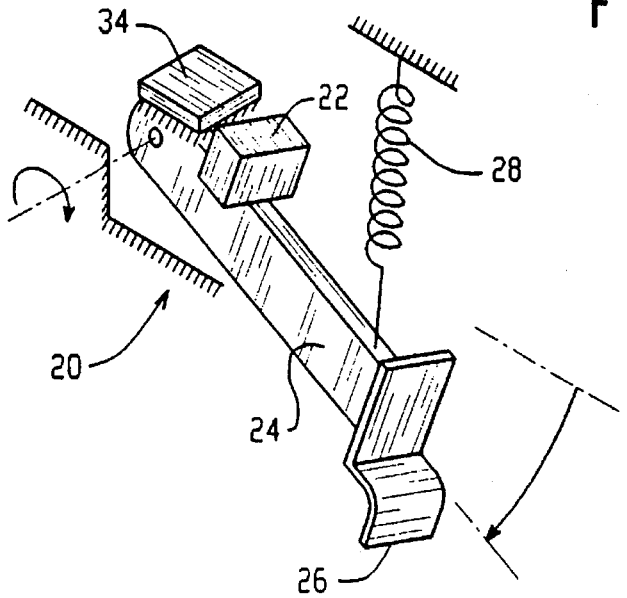

DRIVE SYSTEM FOR A SLIDING CHAMBER DOOR

BACKGROUND OF THE INVENTION

Sterilizers and autoclaves are generally used in hospitals, industrial laboratories and other facilities for the purpose of sterilizing various solid, porous and liquid articles. Typically, the sterilizer or autoclave chamber is located in a wall between a controlled environment room such as a laboratory or an operating room and an adjacent room wherein the strict environmental controls and parameters are not maintained.

Vertically sliding doors are typically used in connection with such machines because they require a minimum of space in relation to the size of the opening they provide and they do not interfere with the loading and unloading of the machine. Such vertical sliding doors typically lower to open the autoclave and raise to a closed position.

Often, autoclave doors are electrically powered, with a switch-actuated motor drive system being used to raise and lower the door. Such powered doors pose a potential safety risk to autoclave operators in the event that the door is activated while the user's arms obstruct the path of the door. Such accidental activation may also damage articles being inserted or removed from the autoclave.

In order to avoid such damage or injury in the event of door obstructions, expensive and elaborate systems have previously been employed. Some prior systems employ expensive electrical sensing systems which detect door obstructions and generate a signal directing the motor to stop or perhaps reverse door motion, thus protecting the user and the sterilized articles. However, such systems are not entirely fail-safe. Sensors require optimal placement in order to detect obstructions. Also, the sensors must be adequately protected against the adverse conditions of the hot, humid sterilizer environment. Further, the sensor must satisfactorily be able to communicate with the circuitry driving the door motor. In view of these considerations, such obstruction sensing systems do not offer optimal fail-safes for user protection.

Obstructions to the autoclave door also have the potential to damage the motor drive system. Obstructing a door's motion prior to its limit of travel causes the motor to experience a dead-end load resulting in high stall torques that could produce damage or failure in the motor and the other drive components. A similar situation may result if an impatient operator attempts to manually actuate the powered door with an excessive force while the door is moving or stationary. This situation creates high induced loads within the motor and drive components that could also result in damage or failure. Such problems may also inadvertently arise during a power failure, e.g. in the wake of an electrical storm. With a prior system, a door may not be opened during a power failure without producing the same damage to the drive components.

In order to guard against such system damage, it has been necessary in the prior art to design the respective components to withstand such forces, or else incorporate expensive slip clutches or other such safeguards. Slip clutches require precision machining or adjustments in order to insure proper shaft alignments. Thus, expensive and elaborate arrangements must be provided in order to protect the motor parts either from obstructions or opening with excessive force.

Manual sterilizer doors have been conventionally opened with a door mounted handle for hand opening. Similarly, for powered doors, it is also known to have a power actuation switch generally mounted within arms reach for hand actuation. However, it is typical for operators to approach an autoclave unit carrying a load to be sterilized. In order to gain entry into the autoclave, the load must either be set down or held precariously in one hand while opening the door, creating inconvenience or even potential danger to the operator. Similar difficulties arise while removing the load. It would be desirable to minimize any inconvenience or danger to the operator.

In prior systems, it has been known to use mechanical securements such as detents and laches for securing autoclave doors. Such securements can be complicated and require precise alignment in order to function as desired. Also, such securements are susceptible to damage. it would be desirable to provide a securement that does not suffer from such drawbacks.

Additionally, in prior autoclaves, different mechanical structures are used for manually-opened doors than for powered doors. Due to these differences in hardware, it has been difficult to retrofit a manual door to include powered components.

SUMMARY OF THE INVENTION

The present invention overcomes the problems associated with these prior systems. The present invention is directed to an apparatus for removably enclosing the opening of a chamber. This apparatus includes a door, movably mounted to an entry side of said chamber with a counterweight being mechanically connected to the door, the door and counterweight together forming a door/counterweight system. A cable and pulley system is provided connecting the door to the counterweight, and thereby suspending the door/counterweight system. The apparatus also includes a door actuation assembly for automatically opening the door in response to an actuator, wherein the door actuation assembly effects relative displacement between the door and the counterweight along the cable and pulley system.

In accordance with a first embodiment of the invention, the door drive system is manually operated (i.e. non-motor driven). The counterweight has a weight less than that of the door so as to create a weight imbalance. The cable and pulley system suspends the door and counterweight so as to exploit the weight imbalance between the door and the counterweight. In this first embodiment, the door actuation assembly comprises a securement for releasably engaging the door in a closed position is attached to either the door or the counterweight with a force sufficient to offset the difference in weights between the door and the counterweight. The weight imbalance is sufficient to permit the door to lower automatically under the action of gravity when disengaged from the securement.

The securement of the first embodiment is preferably a magnet which secures a ferromagnetic element in either the door or counterweight. The magnetic securement is preferably disengaged by means of a foot pedal which is mechanically connected with the magnet, and causes the magnet to be disengaged from the door or counterweight.

In a second embodiment of the present invention, the door and counterweight are powerdriven and are displaced by means of a drive system which includes a sheave, i.e., a grooved drive wheel around which a length of cable is looped. The weights of the door and the counterweight in this embodiment are preferably substantially the same. The cable remains in frictional contact with the sheave, so that when the sheave is rotated, the cable is displaced, which results in the raising or lowering respectively of the door and the counterweight.

The drive system of this second embodiment includes an electric gear motor which rotates the sheave in response to an actuation signal from an externally mounted switch. The sheave is fixed to the shaft of the electric gear motor and does not spin freely. The sheave of the second embodiment may be coated with a material that has a desired coefficient of friction which produces a desired level of frictional contact with the cable. Also, friction between the sheave and cable varies as a function of cable tension. A turnbuckle is preferably used to adjust cable tension, and thereby, the friction between the sheave and the cable.

During operation, frictional contact is maintained at low sheave torques, and the cable will not slip along the sheave surface. However, at high sheave torques, such as those encountered during obstructions and applications of excessive force, the cable will harmlessly slip along the surface of the sheave. In the event that the guide mechanism for the door becomes jammed, sheave torques will also become high, and the cable will slip along the sheave surface. In this way, any obstructions or excessive forces that are applied to the door will not be transmitted to the motor.

As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

The preferred embodiments of the invention will now be described by way of example only, with reference to the accompanying figures wherein like members bear like reference numerals and wherein:

FIG. 2 is a perspective view showing a sterilizer with door drive system in an opened position according to a first embodiment of the present invention.

DETAILED DESCRIPTION OF THE PREFERRED EMBODIMENT

Figure 1:
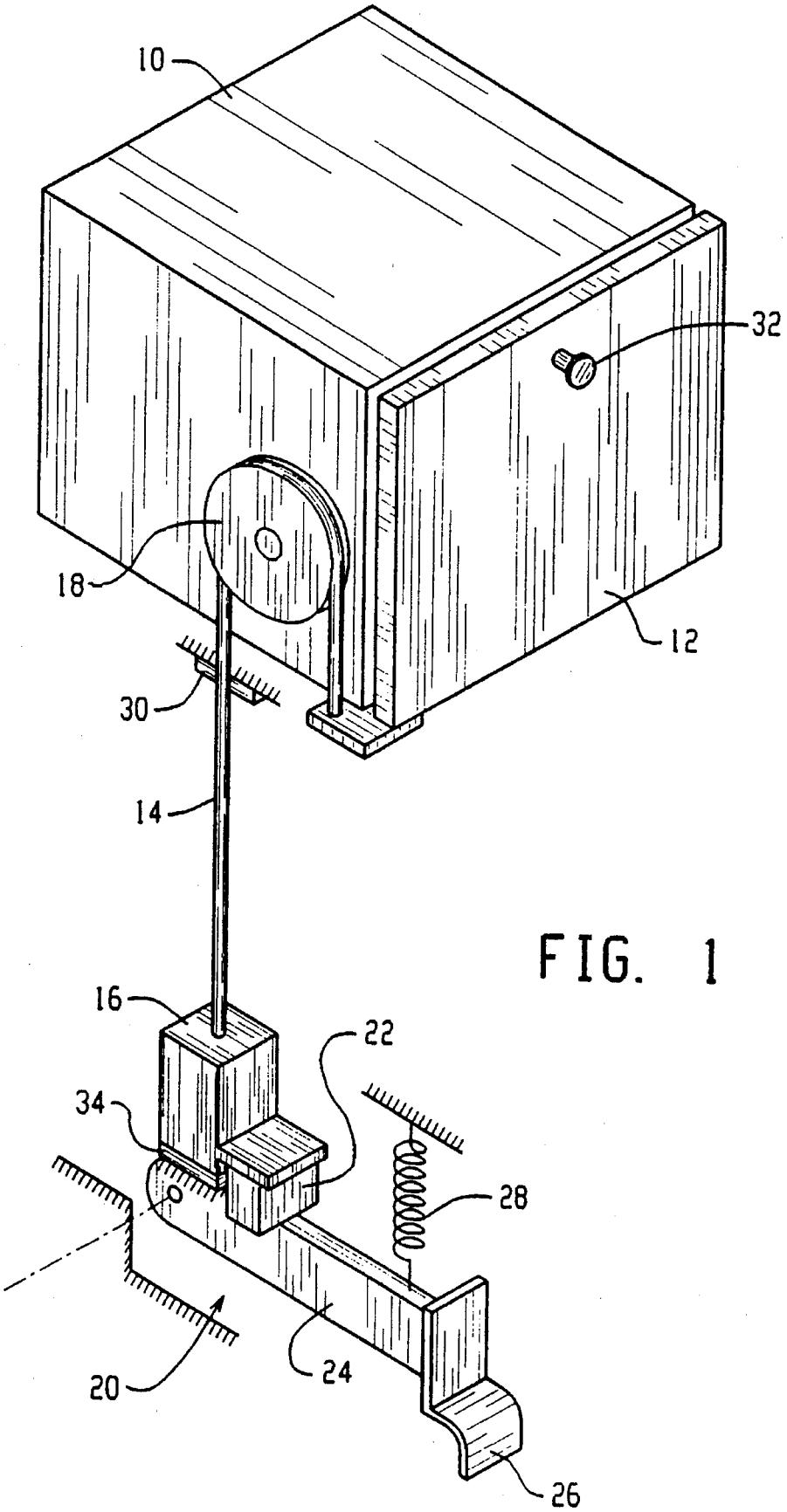
FIG. 1 is a perspective view showing a sterilizer with door drive system in a non-opened position according to a first embodiment of the present invention.

Referring now to the drawings which are for purposes of illustrating the preferred embodiments of the present invention only and not for purposes of limiting the same, the figures show a sterilizer with door driven by the door drive of the present invention. However, the present invention may also be used to control other types of doors and also similarly constructed members.

Figure 3:
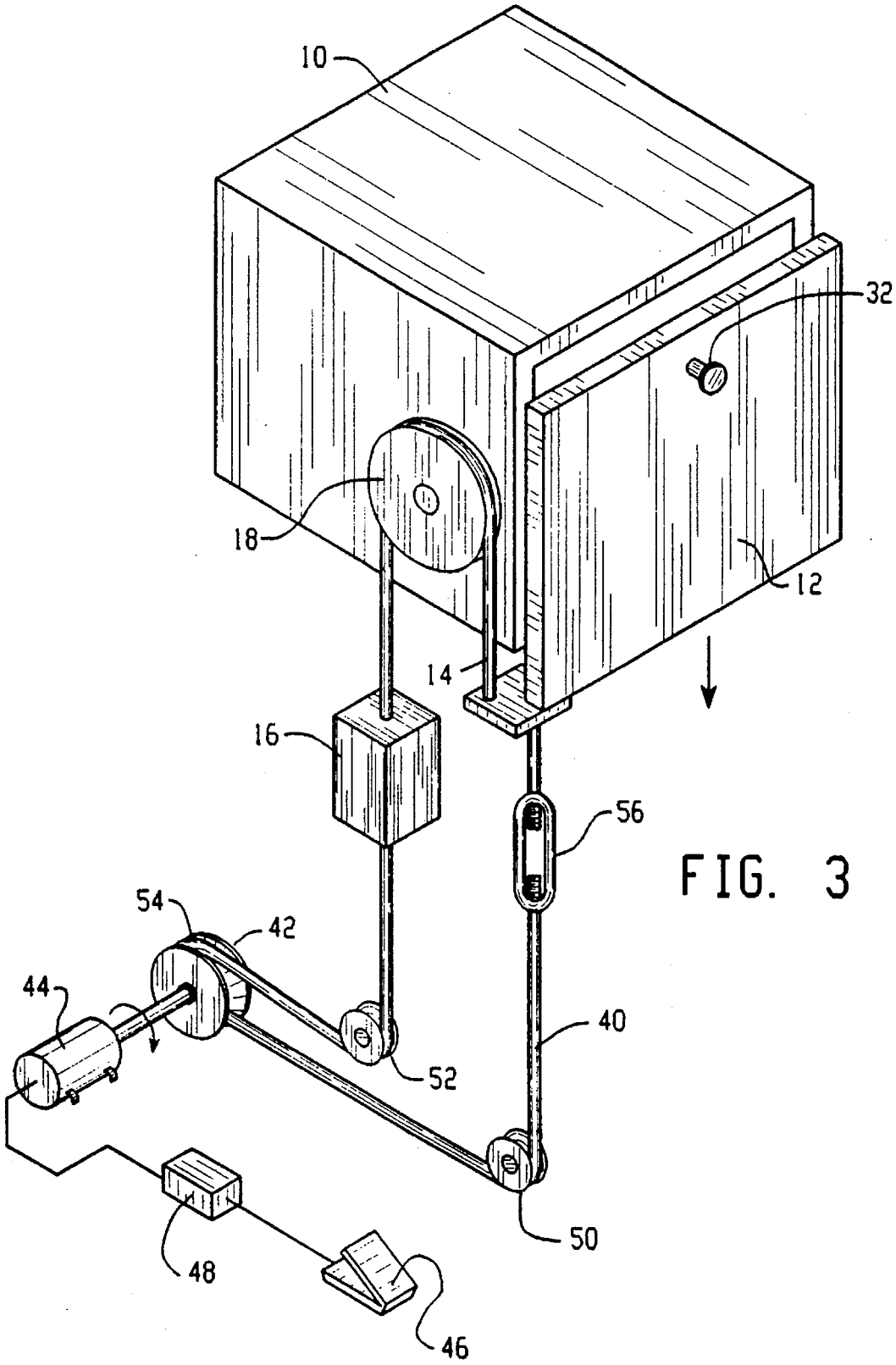
FIG. 3 is a perspective view showing a sterilizer with door drive system according to a second embodiment of the present invention.

More particularly with reference to FIGS. 1 through 3, the sterilizer 10 is exemplary of the typical sterilizers having vertically sliding doors 12, the construction and operation of which are known in the art. The sterilizer 10 is supported above the floor by a support (not shown) which may include legs or a wall mount, or any type of support as is known in the art. For reference purposes, such sterilizer chambers typically have an opening about 16 inches square with a door weighing about 60 pounds.

In accordance with the present invention, the door 12 is connected to a pulley cable 14 which serves to transmit the tensile mechanical force needed to raise and lower the door 12. The pulley cable 14 has one end attached to the door 12 and the other end attached to a counterweight 16. The pulley cable 14 is looped over the top of a pulley 18, which is configured to spin freely and maintain frictional contact with the pulley cable 14.

The door 12 and the counterweight 16 are suspended across the pulley 18 in such a way that they are substantially mechanically balanced. The door 12 and counterweight 16 form a door/counterweight mechanical system across the pulley 18 so that as the counterweight 16 is raised, the door 12 is lowered and vice versa. The weights of the door 12 and the counterweight 16 may be selected so that they are equal, which is particularly useful with a motorized embodiment of the present invention.

In a manual embodiment of the invention, there is a weight difference between the counterweight 16 and the door 12. This weight difference creates a door/counterweight system that favors the raising of the counterweight 16 and the lowering of the door 12. In each embodiment, the door is suspended between two guide rails (not shown) that offer it a smooth track of motion as it is raised and lowered. The guide rails can be any of the types such as are known.

In particular reference to FIGS. 1 and 2, a first preferred embodiment of the present invention is disclosed showing a manual (i.e. non-powered) version of the present invention. In this embodiment, the door 12 and counterweight 16 are suspended by a pulley cable 14 which is looped over the top of a pulley 18.

In the first embodiment, the counterweight 16 has a weight selected to be less than the weight of the door 12, creating an imbalance in the door/counter-weight system. The counterweight 16 is held in place with a securement 20 at its lower limit of travel, with the door 12 thus being retained at the closed position. When the securement 20 holding the counterweight 16 is disengaged, the force of gravity acts on the weight imbalance in the door/counterweight system, which is sufficient to permit the door 12 to slowly move downward as the counterweight 16 is drawn upwards. The weight imbalance is preferably small due to the selection of weights, but still large enough so that the door will open quickly enough for the intended use. The securement 20 is preferably in the form of a magnet 22 which is mounted to magnetically retain the counterweight 16 with a magnetic force that is sufficiently greater than the weight imbalance in the door/counterweight system to hold the door closed when engaged. The magnet 22 is mounted to a lever arm 24 which is pivotally mounted to the sterilizer housing, the floor or another stable surface. However, the securement may also be any of a variety of mechanical-type securements as are known in the art, such as detents and laches.

The lever arm 24 is depressed, preferably with a foot pedal 26, and the magnet 22 is moved sufficiently far from the counterweight 16 so it does not maintain significant magnetic influence over the counterweight 16. The counterweight 16 is thus disengaged and is permitted to move freely upward. The lever arm 24 is restored to its original position by a return spring 28 which is extended when the lever arm 24 is depressed. The foot pedal 26 permits the opening of the door 12 even if an operator has no free hands.

After the foot pedal 26 releases the magnet 22 and the door 12 lowers to its open position, the motion of the counterweight 16 is stopped by an energy absorbing elastomeric pad 30, which is mounted at the upper limit of travel for the counterweight 16. This elastomeric pad 30 cushions the impact of the counterweight 16, resulting in a soft stop of the counterweight 16 and the door 12.

After articles are inserted or removed from the sterilizer 10, the door 12 is raised back to its closed position using a door handle 32. A second elastomeric pad 34 is placed at the lower limit of counterweight travel, cushioning the counterweight 16 at this limit, at which place it is again secured by the magnet 22. These elastomeric pads 30, 34 can also be used with the first preferred embodiment to limit the travel of the counterweight 16 of that embodiment.

Rather than using the foot pedal 26, the door 12 may alternatively be opened by simply pulling the handle 32 with sufficient force to disengage the magnet 22, and as such, the foot pedal 26 need not be used. The use of the magnet 22 avoids the complicated detents and latching arrangements which require precise alignment and are susceptible to damage. Additionally, the magnet 22 does not require any energy to engage, as does a detent. Thus, engagement is greatly simplified. In particular reference to FIG. 3, a second preferred embodiment of the present invention is disclosed showing a powered version of the present invention. The door 12 and counterweight 16 are connected with both the pulley cable 14 and also a drive cable 40. The drive cable 40 attaches to opposing vertical sides of the door 12 and the counterweight 16 respectively from the pulley cable 14. In this second embodiment of the invention, the door 12 and the counterweight 16 can have the same weights, or they can be different, so as to create a weight imbalance. Preferably, the weights are substantially the same.

The drive cable 40 is looped around the surface of a sheave 42. The sheave 42 is generally cylindrical in shape and serves as the drive member for the door/counterweight system. The sheave 42 is designed to be rotationally driven about its cylindrical axis. The drive cable 40 maintains frictional contact with the sheave 42 so that, as the sheave 42 rotates, the drive cable 40 is displaced, drawing the door 12 downward, permitting the counterweight 16 to be raised. The sheave 42 is rotated by a drive mechanism, preferably an electric gear motor 44.

The electric gear motor 44 is actuated in response to signals from a switch mechanism, preferably a foot-actuated pedal 46. The mechanical pedal 26 from the manual (i.e. non-powered) version, may be adapted to incorporate an electrical switch, so as to facilitate retrofitting of a powered drive system onto a manual version. The switch mechanism may alternatively be positioned and configured to be actuated by an elbow or by any other manner which may be contemplated by the person of ordinary skill.

Upon actuation, the foot-actuated pedal 46 transmits signals to the gear motor 44 through the appropriate electrical control system 48. The electrical control system 48 may be any of various control systems of this type known to the person of ordinary skill. In the preferred embodiment, the control system 48 includes a microprocessor control unit (preferably an AMSCO Main Control Box Assembly 146657-782 driven by an Intel 186 processor chip) that actuates the gear motor 44 in response to signals from sensors.

The drive cable 40 is looped around the sheave 42 to produce the desired level of frictional contact. In the preferred embodiment, the cable 40 contacts the sheave 42 for approximately three-quarters of a turn around the sheave 42 diameter. As shown in FIG. 3, the connecting ends of the drive cable 40 may be positioned in vertical alignment under the door 12 and counterweight 16 by means of alignment pulleys 50, 52. By using such alignment pulleys 50, 52, the drive cable 40 ends are positioned in alignment with the directions of motion for the door 12 and counterweight 16. Such alignment permits optimal transmission of tensile force along the drive cable 40.

In order to maintain the desired contact between the sheave 42 and the drive cable 40, the sheave includes a groove 54 which defines a track for guiding the drive cable 40 as the sheave 42 rotates. In order to insure the desired level of frictional contact, the sheave 42 and the drive cable 40 are both preferably coated with plastic materials. In the preferred embodiment, the sheave 42 is coated with vinyl and the drive cable 40 is coated with nylon.

In the operation of the door drive system of the second embodiment, the sterilizer operator actuates the foot pedal 46 which includes a switch that sends a signal to activate the gear motor 44 which in turn rotates the sheave 42, thus lowering the chamber door 12. During the lowering of the door 12, the gear motor 44 is operating at low torques, since the weight difference between the door 12 and the counterweight 16 is preferably negligible. The gear motor 44 is a reversible electric motor, preferably a "permanent split capacitor field motor" such as Model No. BM 6209, manufactured by EMC Motor Company.

The processor in the control system continues motor operation for a timing interval of preferably 10 seconds, until the door is fully lowered to the open position. When the door 12 is to be closed, the foot pedal 46 is again actuated, and the processor reverses the gear motor 44, and the door is raised for another 10 seconds. Alternatively, the control system 48 may include a "door up" sensor, preferably a proximity sensor such as a Hall Effect sensor which detects the changes in magnetic field produced by the proximity of the metal door 12. A signal from the "door up" sensor will discontinue upward motion when the chamber is closed, prior to the end of the timing interval. A similar sensor may also be used to indicate the "door down" position.

Occasionally during use, the situation may arise where the door 12 is inadvertently raised during loading or unloading of the sterilizer, at which time the operator's arms or the sterilized articles would obstruct the sterilizer opening. In the event of such obstructions, the full force of the door 12 will bear down on the obstruction, causing damage or injury. Also, as the vertical advance of the door 12 is halted, the torque of the gear motor 44 would reach a high level, which may cause damage or failure to the motor 44. Such damage to the motor 44 could also result if an impatient user were to pull the door 12 down with excessive force, which would induce high torques into the motor 44.

Such damage is precluded by the degree of frictional contact which exists between the drive cable 40 and the sheave 42. This frictional contact is sufficient to permit displacement of the door/counterweight system while operating at low torques. Under high torques, either induced or encountered from obstructions or jamming, the degree of friction between the drive cable 40 and the sheave 42 is insufficient to permit these two to remain in contact, and the drive cable 40 will slip harmlessly along the surface of the sheave 42 or else harmlessly backdrive the motor. Once the obstruction or excessive force is removed, the drive cable 40 and sheave 42 reestablish frictional contact and normal operation of the drive system resumes, without damage or injury to the operator or the unit.

The level of frictional contact between the drive cable 40 and the sheave 42 is a function of the tension on the cable and the coefficient of friction between the sheave 42 and the drive cable 40 and also the length of contact between these elements. In the preferred embodiment, with the cable being properly tensioned, the friction produced by the contact of the nylon coated drive cable 40 to the vinyl coated sheave 42 is low so that, at relatively low motor torque, the drive cable 40 will slip on the sheave 42 insuring that maximum cable tension is proportional to a low motor torque.

The frictional force can be varied to a desired optimal level by varying the tension on drive cable 40. In the preferred embodiment, a turnbuckle 56 is inserted in line with drive cable 40 in order to increase or decrease cable tension to an optimal level. After adjustment and during operation, in the preferred embodiment, it has been found that two pounds of cable tension will drive a 60 pound door using a six inch-pound motor operating at six RPM's with a six inch diameter sheave.

This second preferred embodiment need not be exclusively operated in the motor-driven power mode, but may also be operated in a manual override mode. The door 12 includes a handle 32 which may be grasped and pulled. In the event of power failure or instrument malfunction, the handle 32 may be pulled with sufficient force to overcome the frictional force of contact. The drive cable 40 will then harmlessly slip along the surface of sheave 42 or harmlessly backdrive the gear motor 44. Thus, the powered door drive may be used in a manual mode without clumsy and expensive manual override elements, thus permitting user access to the chamber under all circumstances.

Both the first and second embodiments of the invention use similar components. The autoclaves, doors, guide rails and other components are identical from the manual to the powered embodiments. In this way, the manual embodiment can be easily retrofitted in the field to include a powered drive, improving the efficiency and minimizing the cost of upgrading.

As described hereinabove, the present invention solves many problems associated with the prior door drive systems, and presents an efficient door drive that offers safety to operators while avoiding damage to itself. The present invention also provides a device which accomplishes its objectives without expensive and elaborate systems that can fail or become damaged. However, it will be appreciated that various changes in the details, materials and arrangements of parts which have been herein described and illustrated in order to explain the nature of the invention may be made by those skilled in the art within the principle and scope of the invention as expressed in the appended claims.

What is claimed is:

1. An apparatus for removably enclosing the opening of a chamber, said apparatus comprising:

a door, movably mounted to an entry side of said chamber;

a counterweight being mechanically connected to the door, the door and counterweight together forming a door/counterweight system wherein the door and the counterweight have different weights so as to create a weight imbalance;

a cable and pulley system connecting the door to the counterweight, and thereby suspending the door/counterweight system; and a door actuation assembly substantially in operative mechanical contact with the door/counterweight system for automatically opening the door in response to an actuator, wherein the door actuation assembly comprises a securement, attached to a stationary surface of the apparatus, for releasably engaging the door in a closed position, wherein said securement, when engaged, supplies a securing force sufficient to offset the difference in weights between the door and the counterweight, and wherein, when the actuator disengages the securement, the weight imbalance is sufficient to permit the door to open automatically by gravity acting on the weight imbalance.

2. The apparatus according to claim 1 wherein the actuator comprises a mechanical release mechanism for disengaging the door from the securement.

3. The apparatus according to claim 2 wherein said mechanical release mechanism further comprises a foot-actuated pedal.

4. The apparatus according to claim 1 wherein said securement comprises a magnet which magnetically secures the door/counterweight system, thus holding the door in a closed position.

5. The apparatus according to claim 4 wherein the actuator comprises a mechanical release mechanism comprising a foot-actuated pedal connected to said magnet whereby actuation of the foot-actuated pedal moves the magnet, causing the magnet to lose magnetic influence, thereby releasing the door/counterweight system for displacement.

6. An apparatus for removably enclosing the opening of a chamber, said apparatus comprising:

a door, movably mounted to an entry side of said chamber;

a counterweight being mechanically connected to the door, the door and counterweight together forming a door/counterweight system;

a drive system for displacing the door/counterweight system;

a cable and pulley system for mechanically connecting the door to the counterweight including:

a pulley cable connected to both the door and the counterweight, thereby suspending the door/counterweight system;

a drive cable attached to opposing vertical sides of both the door and counterweight from the pulley cable and engaging the drive system so as to effect displacement of the door/counterweight system;

said drive system including:

a sheave around which a length of the drive cable is looped;

a motor, directly connected to the sheave, for rotating the sheave, wherein said cable is maintained in frictional contact with said sheave such that, as the sheave is rotated, the cable is displaced, respectively displacing the door/counterweight system.

7. The apparatus according to claim 6 wherein the drive system includes an electric gear motor which rotates the sheave in response to an actuation signal from an externally mounted switch.

8. The apparatus according to claim 7 wherein the externally mounted switch comprises a foot-actuated pedal.

9. The apparatus according to claim 6 wherein the sheave and cable are coated with respective materials having predetermined coefficients of friction.

10. The apparatus according to claim 9 wherein the sheave is coated with vinyl and the cable is coated with nylon.

11. The apparatus according to claim 6 wherein friction between the sheave and the cable is varied as with cable tension, whereby frictional contact is maintained with the cable at low sheave torques, and at high sheave torques, the cable will slip along the sheave surface.

12. The apparatus according to claim 11 wherein cable tension is varied with a turnbuckle, placed in line with the cable.

13. The apparatus according to claim 6 wherein the sheave includes a groove which receives and accommodates the cable.

14. The apparatus according to claim 6 wherein the counterweight weighs substantially the same as the door.

* * * * *